US005401193A

United States Patent [19]

Lo Cicero et al.

[11] Patent Number: 5,401,193

[45] Date of Patent: Mar. 28, 1995

[54] PATCH PANEL SYSTEM

[76] Inventors: Rae-Ann Lo Cicero, 5 Waco Cir., Chelmsford, Mass. 01824; Stuart Morgan, 3 Assabet Rd., Westford, Mass. 01866; Michael Romm, 203 Lakeshore Rd., #4, Brighton, Mass. 02135; Norman Wainio, 40 Tanglewood Dr., Milford, Mass. 01757

[21] Appl. No.: 16,103

[22] Filed: Feb. 10, 1993

[51] Int. Cl.[6] ..... H01R 9/24

[52] U.S. Cl. ..... 439/713; 361/823

[58] Field of Search ..... 439/131, 709, 713, 719, 439/922, 488, 491; 361/426, 428, 429, 823, 826, 829

[56] References Cited

U.S. PATENT DOCUMENTS

| | | | |
|---|---|---|---|
| 2,953,625 | 9/1960 | Hasselhorn | 174/60 |
| 3,199,068 | 8/1965 | Neenan | 439/713 |
| 3,376,542 | 4/1968 | Vlaminck | 174/60 |
| 3,911,229 | 10/1975 | De Luca et al. | 439/491 |
| 3,945,706 | 3/1976 | Steiner et al. | 439/491 |
| 4,766,521 | 8/1988 | Pelletier | 361/426 |
| 4,958,262 | 9/1990 | Wilkie, Jr. | 439/131 |
| 4,998,343 | 3/1991 | Costello | 439/491 |

*Primary Examiner*—Neil Abrams

*Attorney, Agent, or Firm*—Arthur W. Fisher; Denis G. Maloney; David Suhl

[57] ABSTRACT

Apparatus for patching cables includes a panel 10, FIG. 2 having a patch side for exposing patching connectors, and a punch-down side opposite the patch side for exposing punch-down terminals associated with the connectors. A bracket 12, FIG. 2 supports the panel in a vertical position with the patch side exposed to users. Pivots attach one edge of the panel to the bracket so that the panel can be tilted about the pivot into a position in which the patch side is no longer exposed to users and the punch-down side is exposed to users. There is a supporting surface 40, FIG. 2 for supporting the patch side, when tilted, sufficiently to permit punching down of wires on the punch-down side. The panel may include color coded marking on the patch side for classifying the connector application.

7 Claims, 6 Drawing Sheets

PATCH PANEL SYSTEM

BACKGROUND OF THE INVENTION

This invention relates to patch panels for interconnecting communication cables.

Telephone and data cables in a building, for example, interconnect telephone handsets and computer terminals located at desks and offices throughout the building with each other and with centralized communication facilities, including trunk lines, network servers, and PBX equipment.

To permit flexibility in configuring and later changing the interconnections, cables are run from each telephone, computer, trunk line, PBX, server, and other device, to a central interconnection "closet". The end of each wire of a cable is connected to terminals in a punch-down block which is part of a patch panel. The terminals of the punch-down block are in turn tied to accessible modular connectors. The final interconnection of cables is then achieved by short cables run between selected pairs of the connectors. To reconfigure the interconnection scheme, the user simply disconnects and reconnects the short cables to other pairs of the connectors.

Setting up an interconnection closet is a labor intensive activity. Typically, there are a large number of patch panels. Each patch panel must be assembled from supplies of metal plates and electrical pieces using large numbers of screws. The many hundreds of wires in the cables routed to the closet must be individually punched down into the blocks. Then the patch panels must be individually mounted on a rack or in a cabinet again often using screws.

Occasionally a new cable is run into the closet and must be punched down to one of the blocks. This requires the patch panel to be pulled down from its mounted location to permit access to the back of the blocks where the punching down is done; then the panel must be remounted.

Some patch panels have fronts which are hinged to swing left to right (this requires careful cable management to prevent excessive stresses on the wires) or top to bottom to give access to the back of the panel.

In any case, punching down typically requires that the patch panel be removed from the rack or wall to another location (e.g., a table) which is able to support the panel against the forces involved in the punch down process.

The cables which are punched down in the patch panel may have a variety of functions (e.g., high-speed data line, low-speed data line, voice grade line), and a variety of positions in the hierarchy of interconnect wiring distribution.

Patch panels typically include pre-printed numbers on the front panel which enable the user to identify the cables connected to it. Colors have also been used to indicate applications of the cables connected to the panel.

SUMMARY OF THE INVENTION

In general, in one aspect, the invention features apparatus for patching cables including a panel having a patch side for exposing patching connectors, and a punch-down side opposite the patch side for exposing punch-down terminals associated with the connectors. A bracket supports the panel in a vertical position with the patch side exposed to users. Pivots attach one edge of the panel to the bracket so that the panel can be tilted about the pivot into a position in which the patch side is no longer exposed to users and the punch-down side is exposed to users. There is a supporting surface for supporting the patch side, when tilted, sufficiently to permit punching down of wires on the punch-down side.

Embodiments of the invention include the following features. The pivot attaches the bottom edge of the panel to the bracket. The supporting surface is part of a tray mounted on the bracket. The tray may be moved horizontally towards and away from the panel. The tray is removable from the bracket. The supporting surface is at an angle greater than 180 degrees to the patch surface when the panel is not tilted. The punch-down side includes fingers and stops for removably holding a board bearing connectors. The bracket includes at least two hanger elements for hanging the bracket on a wall mounted plate. The wall mounted plate may have multiple hanger elements for mating with the hanger elements on the bracket to permit the bracket to be hung at any one of at least two possible positions on the plate.

There is a first arrangement of colored markings on the patch side, in the vicinity of the connectors for classifying the connectors based on the application of associated cables. A second, separate arrangement of colored markings, on the patch side and in the vicinity of the connectors, classifies the connectors based on a hierarchy of interconnect wire distribution.

One of the arrangements of colored markings appear raised from the surface of the patch side, e.g., on plugs which are insertable and removable from holes in the patch side of the panel.

Among the advantages of the invention are the following. The panel can be easily assembled, easily mounted, and easily moved, all in a modular fashion, with almost no tools, and minimal labor. Color coding provides useful information and can be changed quickly. Punch-down operations can be performed while the panel remains held in the bracket, by simply tilting down the panel. The tray is adeauately supported to resist strong punch down forces, and thus obviates the need to remove the panel from the rack to another location. This makes punching down simpler, easier, and less time-consuming. The tray is also removable so that a single tray can be used no matter how many panels exist.

Other advantages and features will become apparent from the following description and from the claims.

DESCRIPTION

Figure 5:
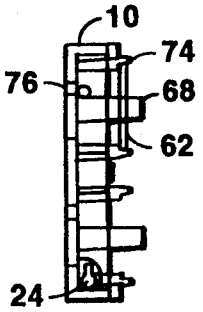
Figure 4:
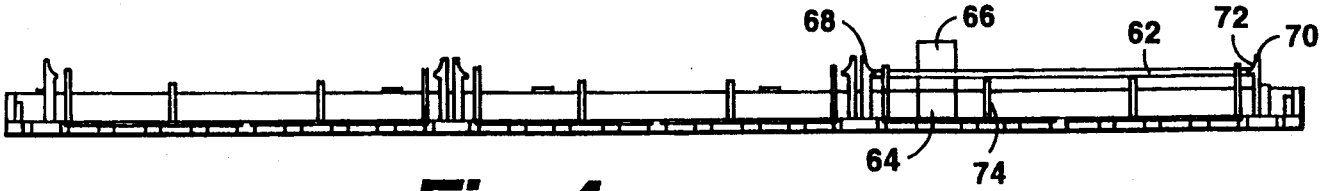
Figure 3:
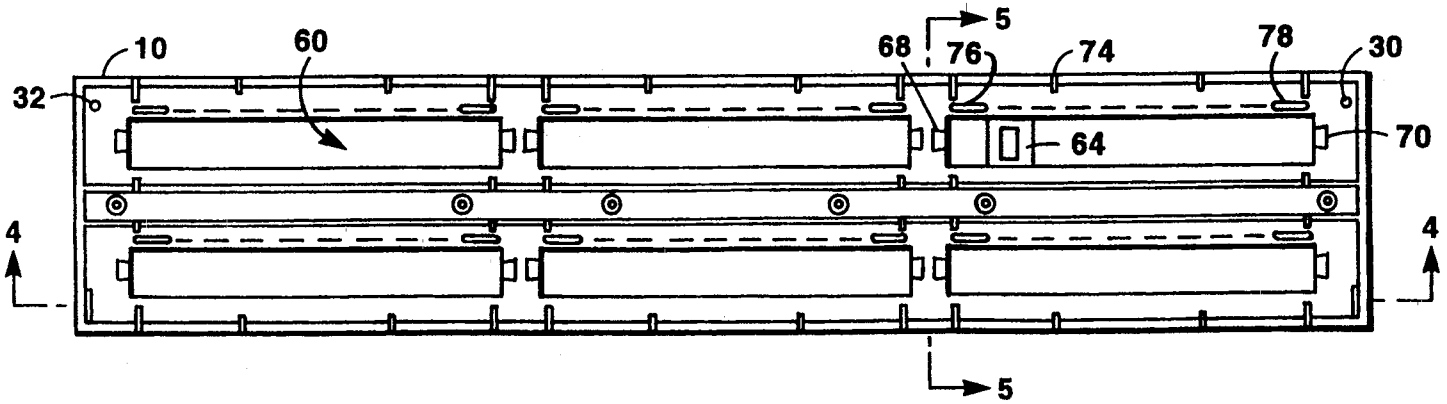

FIGS. 3, 4, and 5 are rear view, sectional views at 4—4, and 5—5, and front view, respectively, of the patch panel.

Figure 6:
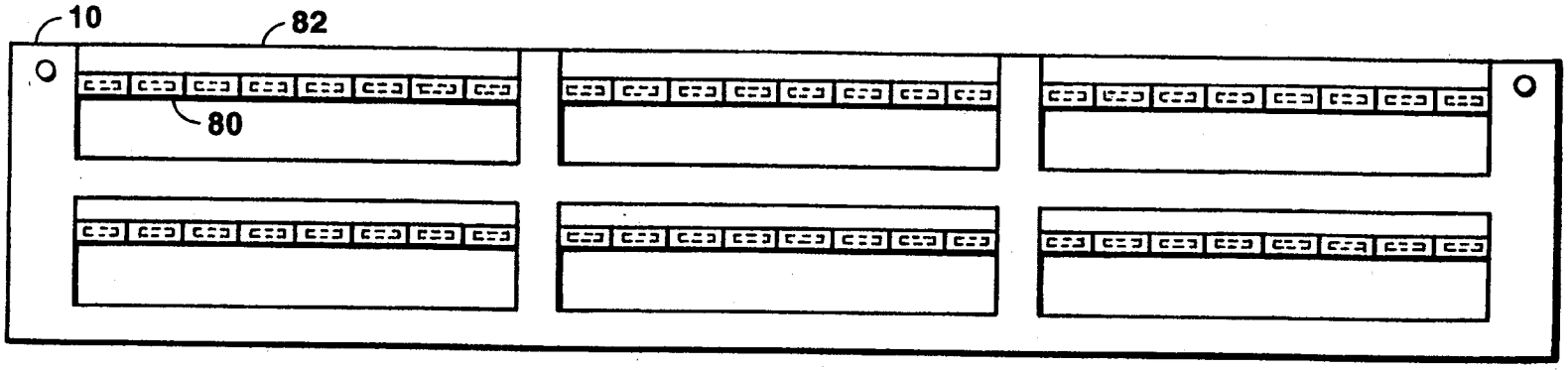

FIG. 6 is a front view of the patch panel with color coding.

Figure 7:
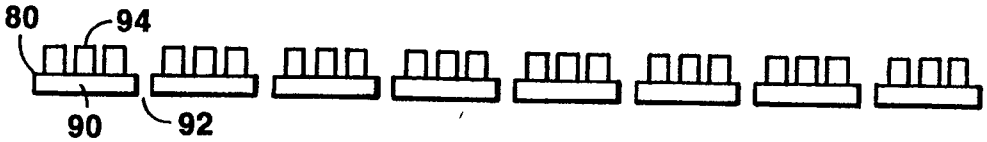
Figure 8:
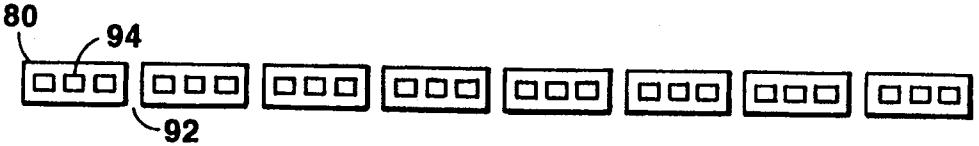
Figure 9:
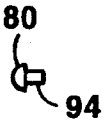

FIGS. 7, 8, and 9 are top, front, and side views, respectively, of a color coding strip.

Figure 10:
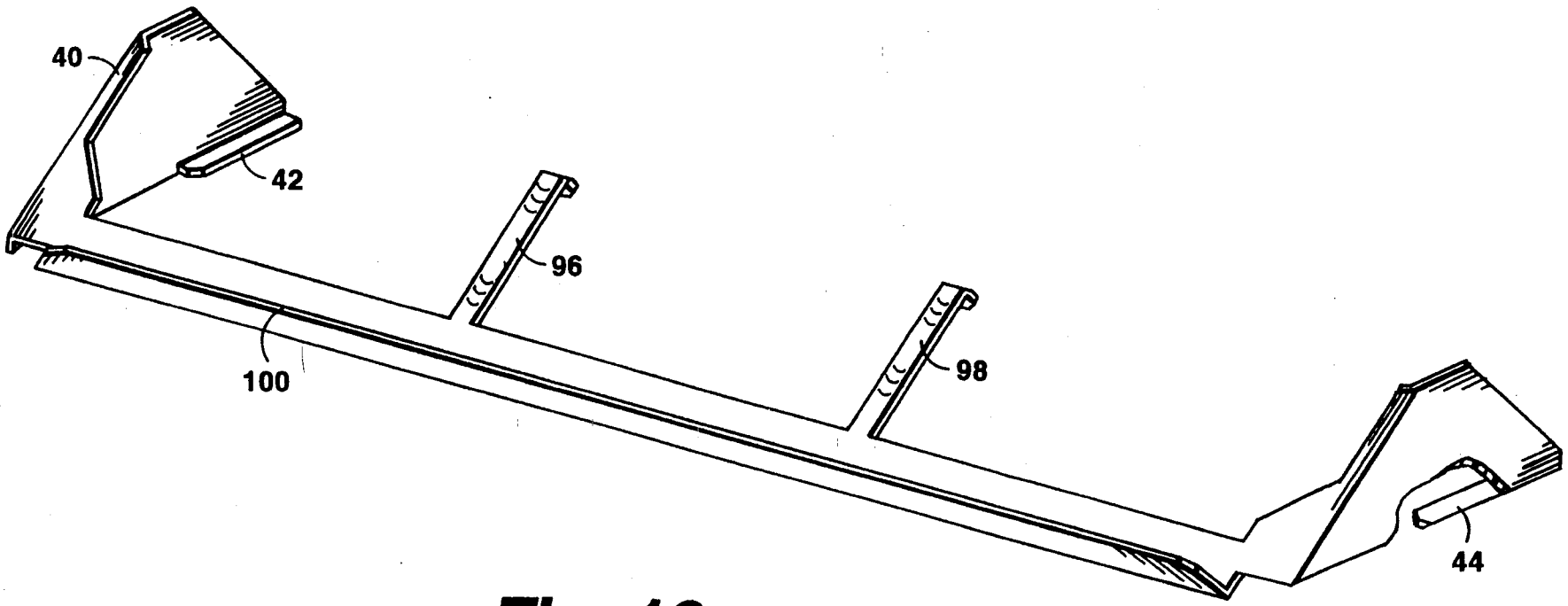

FIG. 10 is a perspective view of a support tray.

Figure 11:
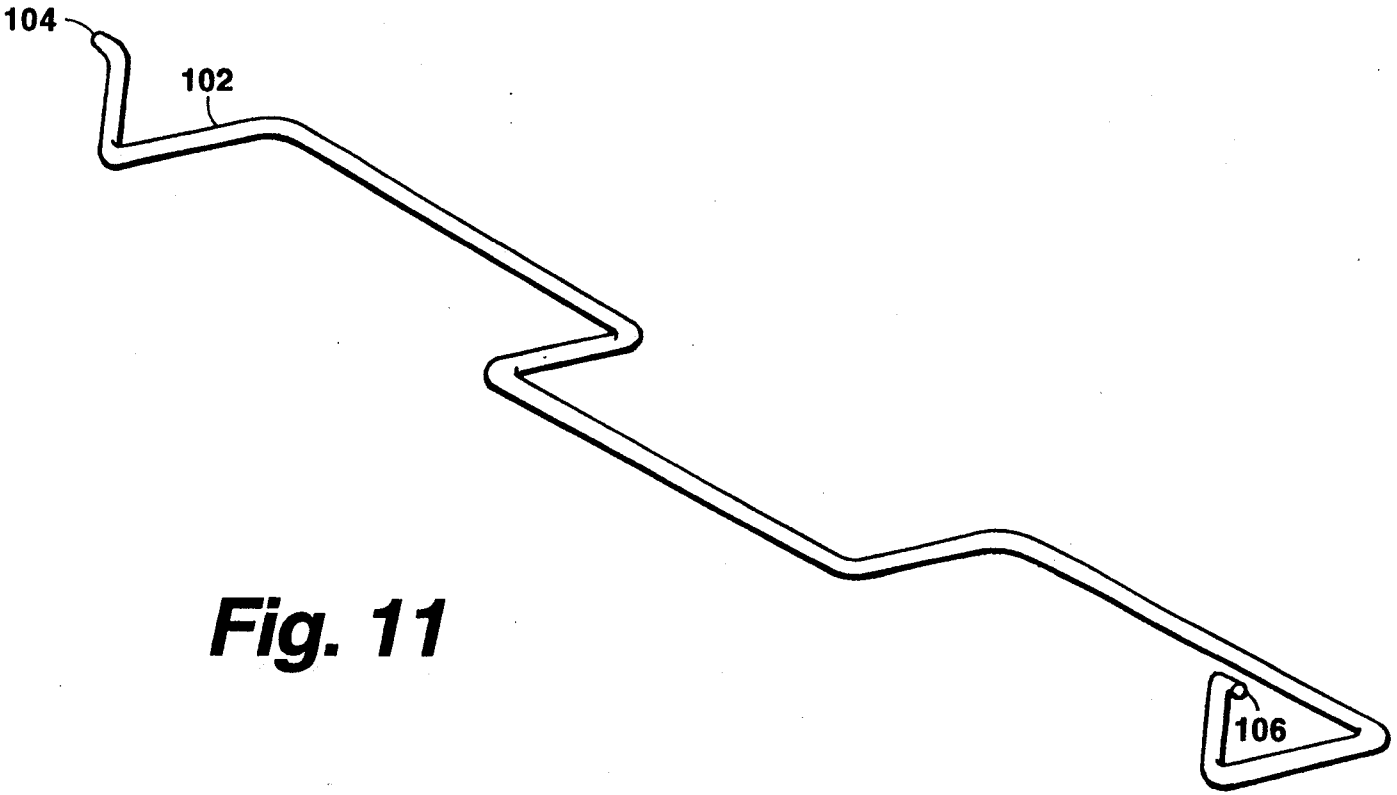

FIG. 11 is a perspective view of a cable management bar.

Figure 1:
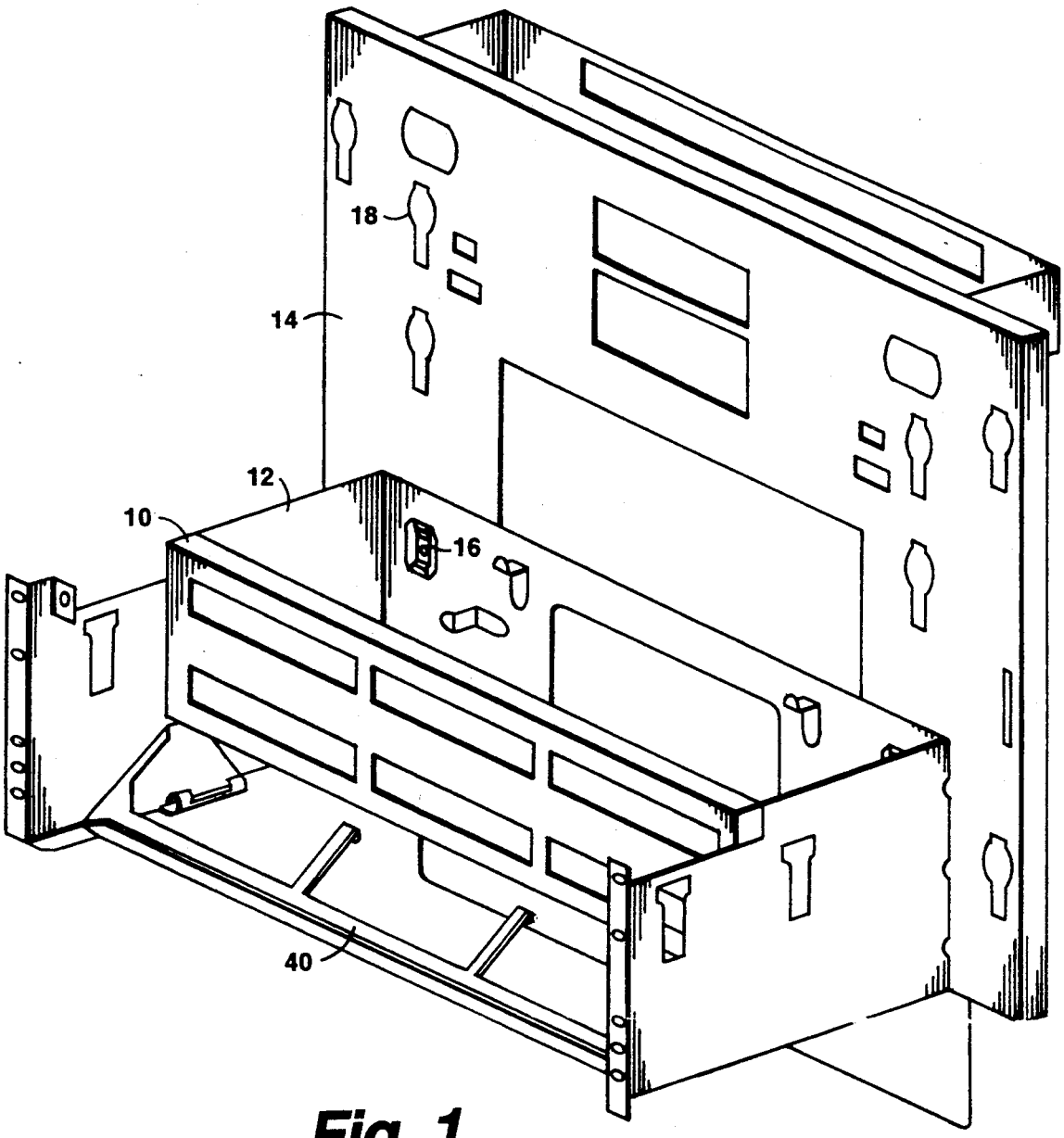
FIG. 1 is a perspective view of a patch panel mounted on a modular support.

Referring to FIG. 1, a patch panel 10 is mounted on a U-shaped bracket 12. U-shaped bracket 12 is suspended on a steel panel 14 using four hanging elements 16 which mate with four corresponding keyholes 18. Panel 14 has sufficient keyholes 18 to permit the U-bracket to be relocated or to permit two U-brackets to be mounted one above the other. Additional duplicates of panel 14 can be mounted above or below it to receive additional U-brackets, all as part of a modular rack system described in greater detail in copending U.S. patent application Ser. No. 08/016,094, filed on the same day as this application, now U.S. Pat. No. 5,333,744, and incorporated by reference. The mating elements and keyholes are part of a fastening system which is more fully described in copending U.S. (attached to bracket 12) which seat in corresponding slots 24, 26 on the ends of panel 10, to permit the panel to be pivoted as suggested by arrow 28. The top of the panel is held by screws that pass through holes 30, 32 in the panel and into holes 34, 36 in the bracket. A tray 40 lies below and in front of the panel to receive and support it when the panel is pivoted down. Tray 40 has two lips 42, 44 which support the tray and ride in two pairs of pockets 43, 45 formed along the bottom edges of the sides of the bracket. The tray can be slid (as suggested by arrow 47) from the position shown in FIG. 2 to a more forward position (farther to the left in the Fig.) to receive and support a panel mounted in an alternative position near the front of the bracket, instead of in the recessed position shown in FIG. 2. Pins 50 and screw holes 52 define the alternative front mounting position.

Cables to be connected to the panel may be fed through an opening 54 in the back wall of the bracket.

Referring to FIGS. 3, 4, and 5, molded plastic panel 10 has two rows of three openings 60 to receive exposed connectors 64 for patching interconnections. Each opening accommodates as many as eight connectors in a row (only one connector is shown). The connectors for a given opening all are mounted on a board 62 so that the connectors 64 will be exposed at the front and punch-down sockets 66 will be accessible at the rear.

Gripping fingers 68, 70 are provided at opposite ends of each opening. The gripping fingers have lips 72 to permit the board to be snapped in place, and are flexible to permit them to be bent to remove a board. Stops 74 along the upper and lower edges of each opening support the board when it is snapped in place.

Above each opening 60 are two in-line rows of small rectangular holes 76, 78 to receive a color coded indicator strip (not shown in FIGS. 3, 4, and 5).

Referring to FIG. 6, on the front of panel 10, a row of numbers are printed below each opening to index the eight connectors of that opening.

In addition, a two-tier color coding scheme is provided above each opening. Immediately above each opening is a removable indicator strip 80 bearing a color which indicates the application to which the cables are devoted. Above the indicator strip is a rectangular label 82 in another color which separately indicates the wiring hierarchy. The label 82 may be either formed permanently on the panel when manufactured, or (preferably) is added by the installer and can be changed by removing or covering the original label.

Referring to FIGS. 7, 8, and 9, the indicator strip 80 is molded plastic having eight semi-cylindrical sections separated by necked down dividers 92. Each section has three prongs 94 for insertion into the corresponding holes in the panel. The semi-cylindrical cross-section makes it easy to insert and remove the strip, and makes the color coding visible in a way that is distinct from the color coding of the flat labels that appear above the strips on the panel. The dividers 92 visually separate the sections of the strip and permit the strip to be torn apart into smaller sections. These smaller sections may be used on specially constructed connector plates, for example, in the offices to which the cables are connected.

Referring to FIG. 10, molded plastic tray 40 has two lips 42, 44 which allow it to be held in place and to slide back and forth with respect to the bracket. The tray may be completely removed and inserted into any other bracket, so that a single tray can serve multiple panels easily. Two fingers 96, 98 and a lip 100 provide support for a tilted-down panel.

Referring to FIG. 11, a cable management bar 102 has two end prongs 104, 106 which can be popped into holes 108, 110 (FIG. 2) in the ends of the panel.

Figure 2:
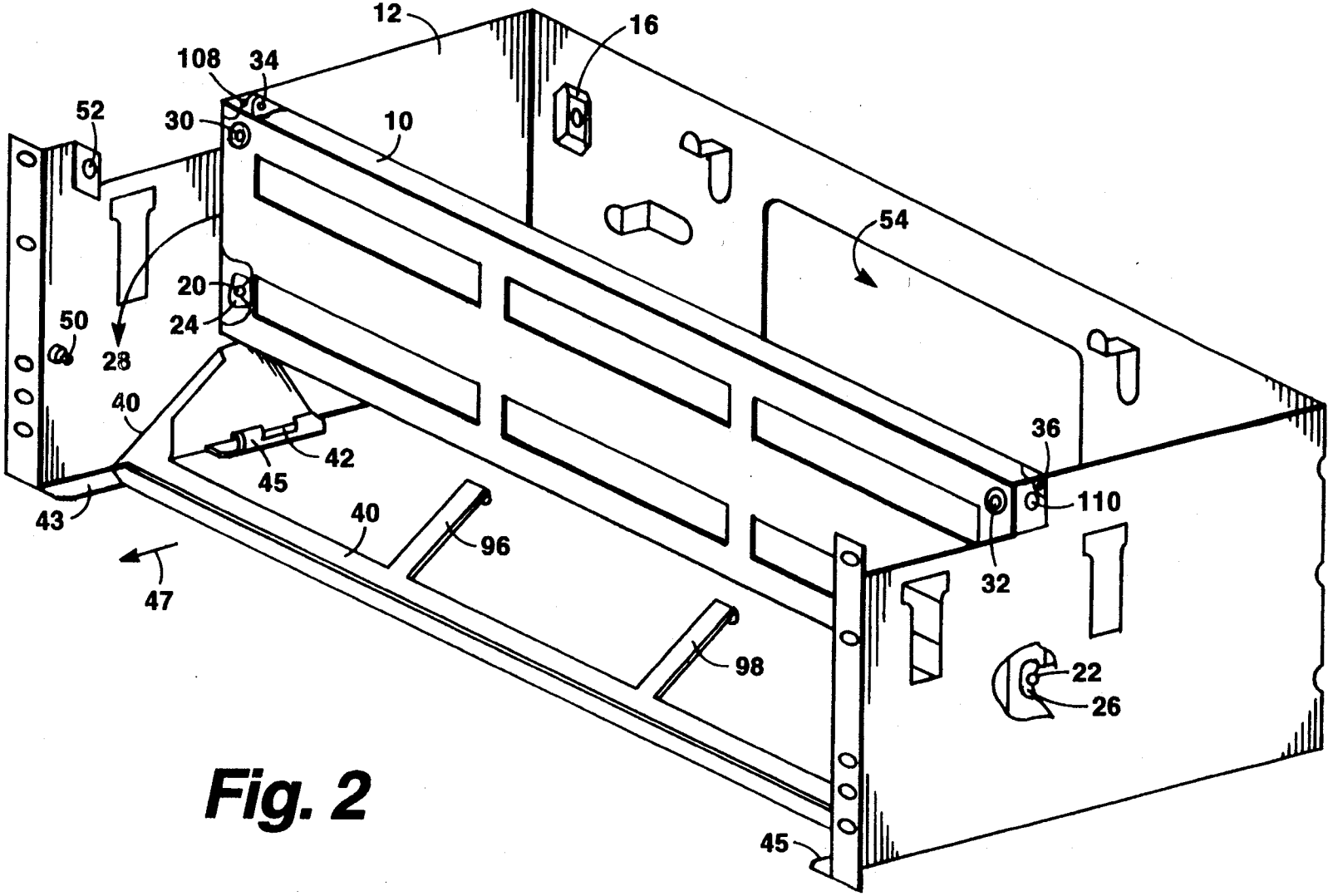
FIG. 2 is a perspective view of a patch panel mounted on a bracket.

Using the panel is simple and quick. For initial installation, boards containing connectors are snapped into the panel 10, FIG. 2 with the connectors exposed in the openings. the bottom holes on the ends of the panel 10, FIG. 2 are then snapped onto a corresponding bracket 12, FIG. 2. The bracket is hung onto the supporting panel 74, FIG. 1. The cables are brought in behind the panel. The tray 40, FIG. 2 is loaded onto the bracket. The panel 10, FIG. 2 is tilted down with its face resting on the tray fingers 96 and 98, FIG. 10. The cable wires are punched down while the panel 10, FIG. 2 remains in place. There is no need to remove the panel to another location for punching down, as the tray is strong enough to support the panel against the punch down force.

Before or after punch down color coded labels are attached to the front of the panel above each opening; and the separately color-coded strips are mounted just above the openings. Finally, the panel is tilted up and the top two screws are put in place. The tray then may be moved to another bracket for use in punching down another panel.

Later punch-down operations and other maintenance can be performed without removing the panel from the bracket simply by tilting it down onto the tray.

Other embodiments are within the scope of the following claims.

What is claimed is:

1. Apparatus for patching cables, comprising a panel having a patch side for exposing patching connectors, and a punch-down side opposite the patch side for exposing punch-down terminals associated with the connectors, a bracket for supporting the panel in a vertical position with the patch side exposed to users, pivots for attaching one edge of the panel to the bracket so that the panel can be tilted about the pivot into a position in which the patch side is no longer exposed to users and the punch-down side is exposed to users, and a support member disposed to contact the patch side of the panel such that, when the panel is tilted, the support member provides support to permit punching down of wires on the punch-down side, wherein the support member is part of a tray mounted on the bracket, and, wherein the tray is mounted to permit the tray to be moved horizontally towards and away from the panel.

2. The apparatus of claim 1 wherein the pivot attaches the bottom edge of the panel.

3. The apparatus of claim 1 wherein the tray is mounted to be removable from the bracket.

4. The apparatus of claim 1 wherein the supporting surface is at an angle between 90 and 180 degrees with respect to the patch side when the panel is not tilted.

5. The apparatus of claim 1 wherein the punch-down side has fingers and stops for removably holding a board bearing connectors.

6. The apparatus of claim 1 wherein said bracket includes at least two hanger elements for hanging the bracket on a wall mounted plate.

7. The apparatus of claim 6 further comprising a wall mounted plate having multiple hanger elements for mating with the hanger elements on the bracket to permit the bracket to be hung at any one of at least two possible positions on the plate.

* * * * *